US005458102A

United States Patent [19]

Tomisawa et al.

[11] Patent Number: 5,458,102

[45] Date of Patent: Oct. 17, 1995

[54] AIR FUEL RATIO CONTROL SYSTEM

[75] Inventors: Naoki Tomisawa; Satoru Watanabe, both of Atsugi, Japan

[73] Assignee: Unisia Jecs Corporation, Atsugi, Japan

[21] Appl. No.: 222,809

[22] Filed: Apr. 5, 1994

[30] Foreign Application Priority Data

Apr. 5, 1993 [JP] Japan ..... 5-078285

[51] Int. Cl.[6] ..... F02D 41/06

[52] U.S. Cl. ..... 123/435

[58] Field of Search ..... 123/435, 436; 364/431.08

[56] References Cited

U.S. PATENT DOCUMENTS

| | | | |
|---|---|---|---|
| 4,216,750 | 8/1980 | Kobayashi | 123/435 |
| 4,543,934 | 10/1985 | Morita et al. | 123/435 |
| 5,331,933 | 7/1994 | Matsushita | 123/435 X |

FOREIGN PATENT DOCUMENTS 5-248281 9/1993 Japan .

*Primary Examiner*—Tony M. Argenbright
*Attorney, Agent, or Firm*—Foley & Lardner

[57] ABSTRACT

An air/fuel ratio control system for an internal combustion engine is effective for improving exhaust characteristics and fuel combustion efficiency. Air/fuel ratio control is carried out by monitoring combustion pressure and analyzing variations therein for frequencies indicative of surge torque. Upon detecting of such indications a map selection function selects data maps from memory for controling the air/fuel ratio to be gradually enriched according to a detected amount of surge torque. If the amount of surge torque is within a predetermined basic range, the system is active to perform lean control for reducing the air/fuel ratio such that the engine may always run as lean as possible without incurring torque loss due to an insufficiently rich air/fuel ratio.

11 Claims, 5 Drawing Sheets

AIR FUEL RATIO CONTROL SYSTEM

BACKGROUND OF THE INVENTION

1. Field of the Invention

The present invention relates generally to an air/fuel ratio control system for an internal combustion engine. Specifically, the invention relates to an air/fuel ratio control system in which engine torque is controlled such that the engine may run as lean as possible, particularly at a time between engine start and engine warming.

2. Description of the Related Art

Generally, in internal combustion engines, at a time between engine starting and engine warming when fuel combustion is carried out at relatively low temperature, a present air/fuel ratio is increased to bring the present air/fuel mixture toward a theoretically determined air/fuel ratio for promoting stable fuel combustion.

Thus, conventionally, an air/fuel ratio at engine starting is set to be on the 'rich' side to allow for different operating environments, etc. However, if the air/fuel setting is rich beyond an amount appropriate to the present operating conditions, fuel combustion and engine exhaust characteristics are degraded and engine performance is reduced.

Recently, for improving combustion and fuel efficiency, so-called lean burning engines, utilizing an air/fuel ratio (e.g. 20–25) lower than a theoretical air/fuel ratio (i.e. 14.7) have been introduced. The present applicant has disclosed in Japanese Patent Application First Publication 4-963, an air/fuel ratio control system which is effective to detect and suppress surges in the air fuel ratio due to torque and speed variations in the engine within predetermined limits.

According to the above-cited disclosure, at the time of engine starting, a correction value for enrichment of the air/fuel ratio is kept as small as possible. Thus, at the time of engine starting, the air/fuel ratio is set to be lean to the limit of surging. According to this system however, a possibility that insufficient torque is generated is present which may cause engine hesitation or stumbling. In a worst case engine stalling may occur.

Accordingly, the present invention discloses an air/fuel ratio control system in which engine surge torque is detected such that the engine may run as lean as possible, particularly at a time between engine start and engine warming.

SUMMARY OF THE INVENTION

It is therefore a principal object of the present invention to overcome the drawbacks of the related art.

It is a further object of the present invention to provide an air/fuel ratio control system for an internal combustion engine which is operable to detect surge torque so as to allow an air/fuel mixture to be as lean as possible.

In order to accomplish the aforementioned and other objects, an air/fuel ratio control system for an internal combustion engine is provided, comprising:

DESCRIPTION OF THE PREFERRED EMBODIMENT

Figure 1:
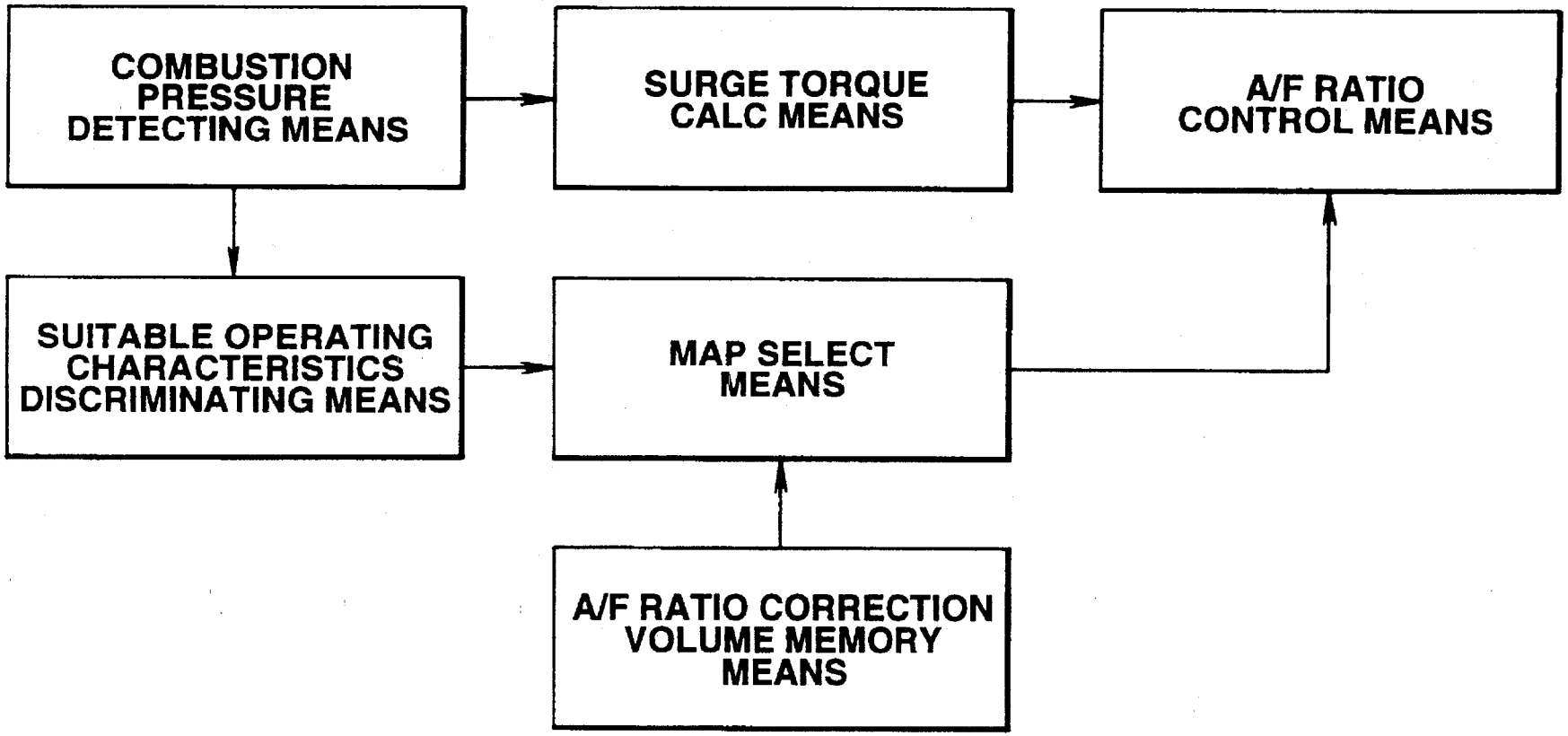
FIG. 1 is a block diagram showing a basic layout of the air/fuel ratio control system according to the invention.

Referring now to the drawings, a preferred embodiment of a air/fuel ratio control system according to the invention will be described hereinbelow in detail.

Figure 2:
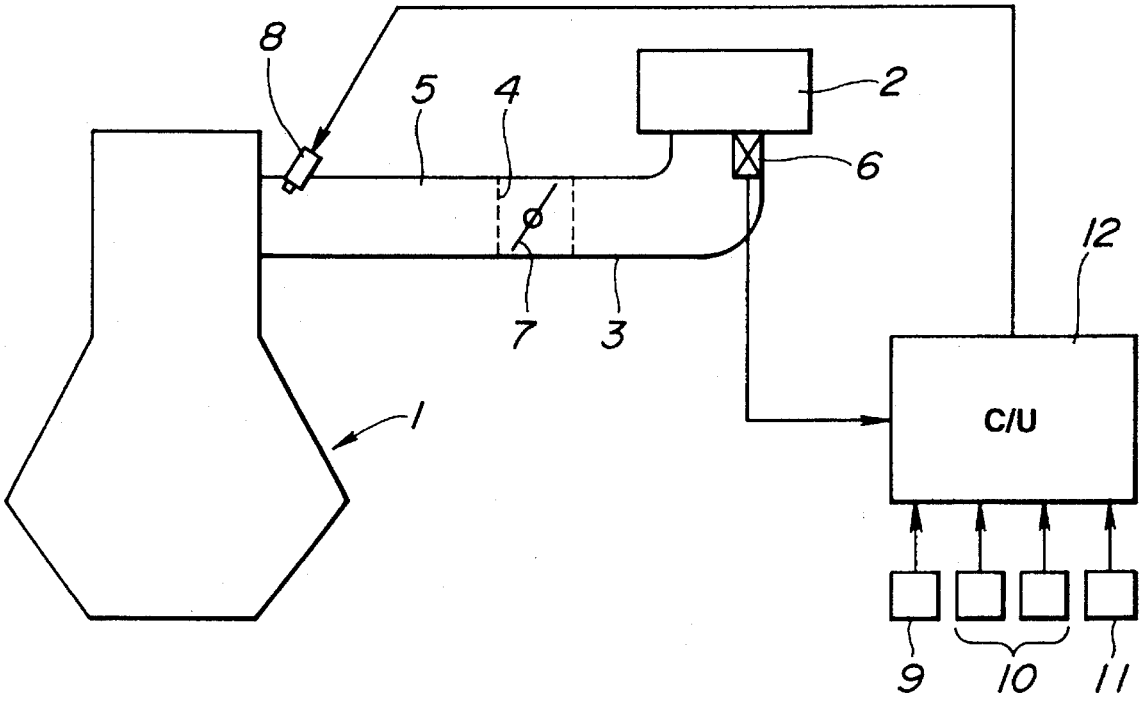
FIG. 2 is a schematic diagram showing components of the control system according to the invention.

Referring to FIG. 2, an air cleaner 2, and air intake duct 3, a throttle chamber 4 and an air intake manifold 5, are arranged between an engine 1 and an air intake (not shown) thereof. An air flow meter 6 is disposed in the air intake duct 3 and an air intake volume Q is detected. The air intake volume Q may be controlled by a throttle valve 7, connected to be operable according to movement of an accelerator pedal (not shown), disposed in the throttle chamber 4.

In the air intake manifold fuel jet means (i.e. an electromagnetic jet valve, hereinafter: fuel jet) 8 is disposed for providing fuel to the engine for combustion. The fuel jet 8 is supplied from a pressure regulator (not shown) associated with a fuel pump (not shown) of the engine 1.

In addition, a crank angle sensor 9 outputs a reference signal REF based on the crank angle phase difference of the engine cylinders (e.g. 4 cylinders at 180°). A fluid temperature sensor 11 detects a temperature of fluid in the engine cooling system (not shown), and combustion pressure (internal cylinder pressure) sensors 10, which may be provided at an end of a spark plug, for example, are disposed in all, or one or more predetermined engine cylinders and output a signal indicative of the detected cylinder pressure. The sensor outputs are input into a control unit 12 which may be a microcomputer or the like. As will be explained in detail hereinlater, the control unit 12 receives the sensor input for detecting surge torque and also, a suitable air/fuel ratio correction volume Sx is determined based thereon. Moreover, the control unit 12 includes memory means for retaining a plurality of data maps relating to a given fluid temperature Tw detected by the fluid temperature sensor and an initial value Sxo of the air/fuel ratio correction volume upon engine starting is set according thereto. A suitable operating condition discriminating means, to be described hereinlater, is active to determine driving conditions while a map is selected from the plurality of data maps according to the detected fluid temperature Tw and the air/fuel ratio correction volume Sx. The air/fuel ratio correction volume differs in the plurality of data maps in that, when the detected fluid temperature Tw is low, a rich air/fuel ratio correction volume is large. Furthermore, the difference in correction volume between each of the data maps is established to be large. On the other hand, when the engine becomes warm the value of the air/fuel ratio correction volume is kept small and the volume differences between each of the plurality of maps is established to be small.

The control unit 12 detects a surge torque level which is responsive to changing of the initial air/fuel ratio correction volume at the time of engine starting and the suitable operating conditions discriminating means is responsive to change the data map to be utilized in response to changing of the air/fuel ratio correction volume, as will be explained in detail hereinbelow with reference to the flowchart of FIG. 3.

At a first step S1 of the steps carried out according to the system of the invention, every cycle of a preselected small unit of time (i.e. 12.8 μs) the combustion pressure value, output by the sensor 11 as an analog signal, is converted to a digital signal.

Then, at a step S2 the combustion opening at the drive stroke of each cylinder is read based on the output of the crank angle sensor for determining if the crank angle is within a predetermined crank angle range.

If a crank angle within the predetermined range is not detected the routine goes to RETURN and repeats, on the other hand if a crank angle within the predetermined range is detected the routine proceeds to a step S3. In step S3 the pressure value converted in step S1 is sampled and stored in memory as initial pressure Pi.

Then, in step S4, an differential value ΔP is calculated based on the sampled value Pi and a value $Pi_{-1}$, which is the cylinder pressure sampled at the previous cycle ($\Sigma(Pi-Pi_{-1})=\Delta P$) for extracting a DC component.

Next, at a step S5, fourier transform operation is performed on the value ΔP derived in step S4 for converting a time component to a frequency component. Since the sampling period is very short, the cycle time is delayed 1–i times so as to correspond to the operating speed of the control unit and the levels for each frequency are then determined.

Then at a step S6, at which a frequency component fn determined as contributing to surge torque (e.g. 3–7 Hz) is derived and a surge torque level signal SU is output.

Figure 4:
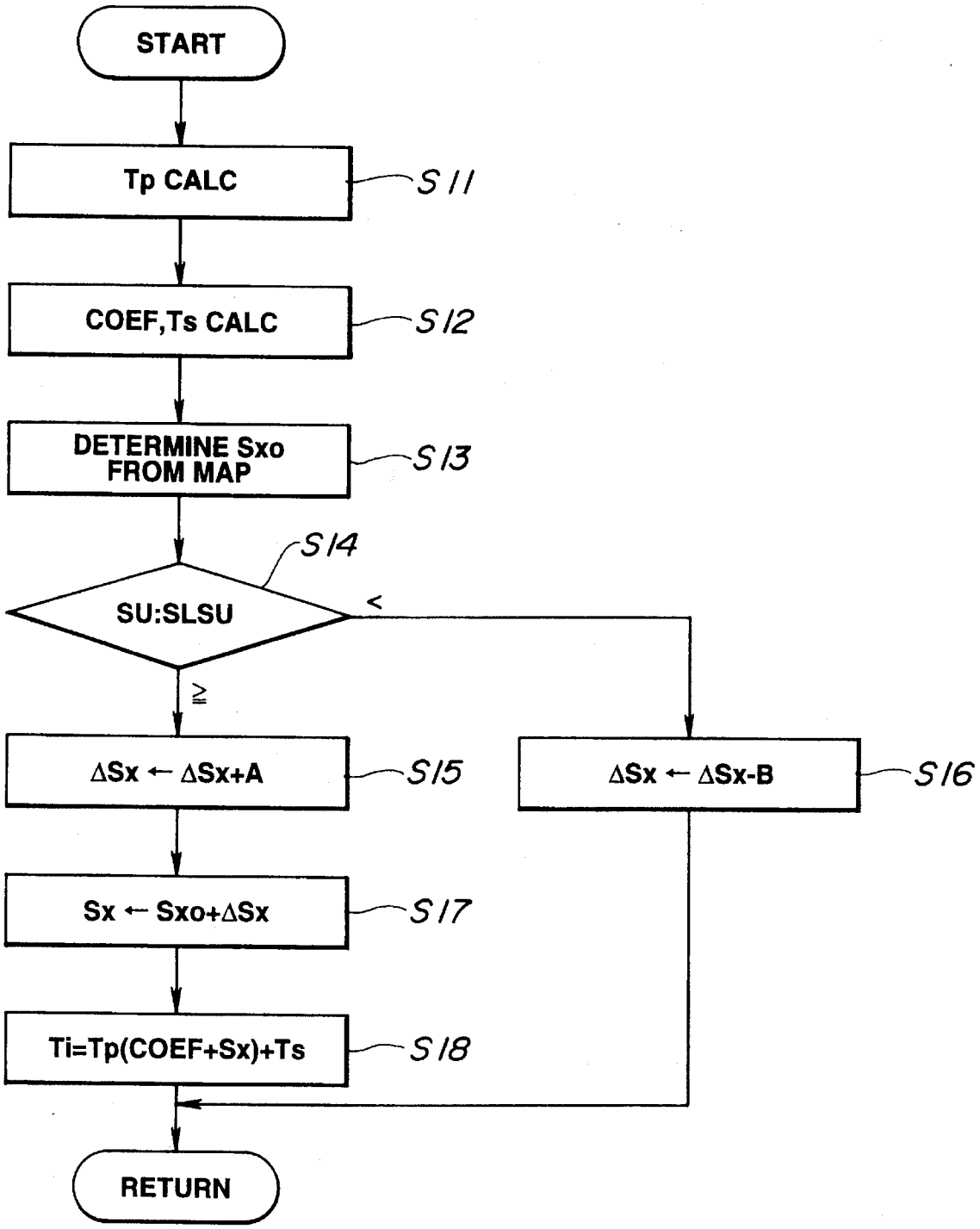
FIG. 4 shows a fuel jet volume setting flowchart.

Next, referring to FIG. 4, a flowchart is shown for determining an 'enrich' level, that is steps for determining a fuel jet volume.

At step 11 (FIG. 4), a basic fuel jet volume Tp (=k·Q/N wherein k is a constant) is determined based on an intake air volume Q measured at the intake air sensor 6, the crank angle detected in step S3, and a detected engine rotational speed N.

Then in step S12, a correction coefficient COEF is derived based on a fluid temperature Tw detected by the fluid temperature sensor 11 and a disqualified jet level portion Ts is deduced.

Next, in a step S13, an initial air/fuel ratio volume value Sxo is selected from a data map (explained in detail hereinlater) based on the fluid temperature Tw.

After, at a step S14 enrich calculation is continued with the value of the surge torque level signal SU being compared with a surge torque reference value SLSU.

At this, is it is determined in step S14 the the surge torque level SU is greater than or equal to the reference value SLSU (SU≧SLSU) the routine advances to a step S15 in which a feedback correction volume ΔSx is renewed based on the initial air/fuel value Sxo of the air/fuel ratio correction volume Sx and the feedback correction volume ΔSx is amplified by a predetermined value A.

On the other hand, if at step S14, it is found that SU<SLSU, the routine proceeds to step S16 where the calculation of the feedback correction volume ΔSx is carried out and the value of ΔSx is renewed by substracting a predetermined value B therefrom and the routine goes to RETURN.

After step S15 however, the routine proceeds to a step S17 at which the initial air/fuel value Sxo is added to the feedback correction volume ΔSx and the air/fuel ratio correction value is set.

Then, in a step S18, the above-mentioned basic jet volume Tp is modified by the derived correction values (for each cylinder) and an actual fuel jet volume Ti is set according to the following equation.

$$Ti=Tp(COEF+Sx)+Ts$$

Figure 5:
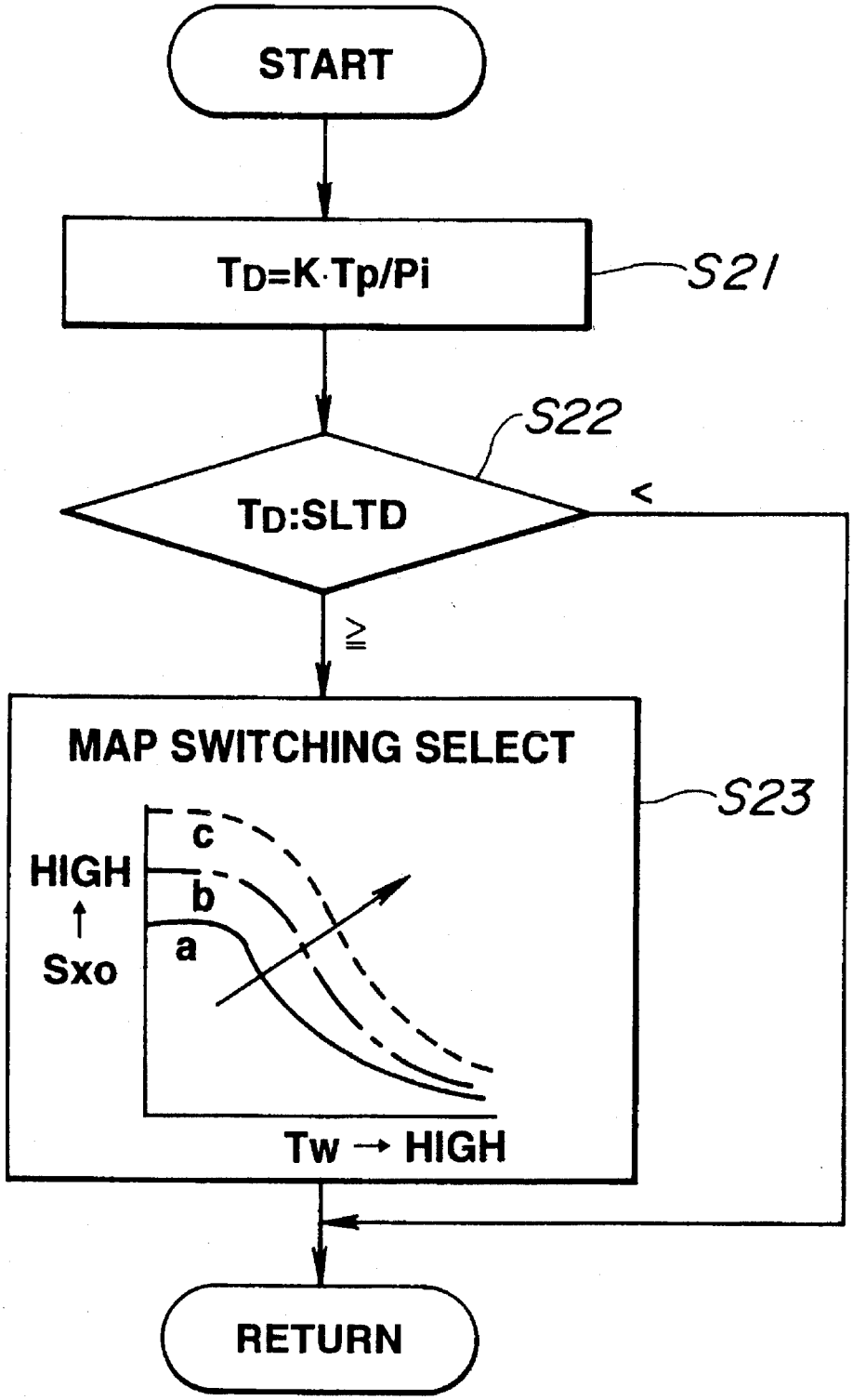
FIG. 5 shows a flowchart for selection and switching of a map for determining an air/fuel ratio correction volume.

Now, referring to FIG. 5, a flowchart is shown for explaining operation of a map selection means controlling the selection and switching of data maps concurrent with discrimination of driving conditions.

Figure 3:
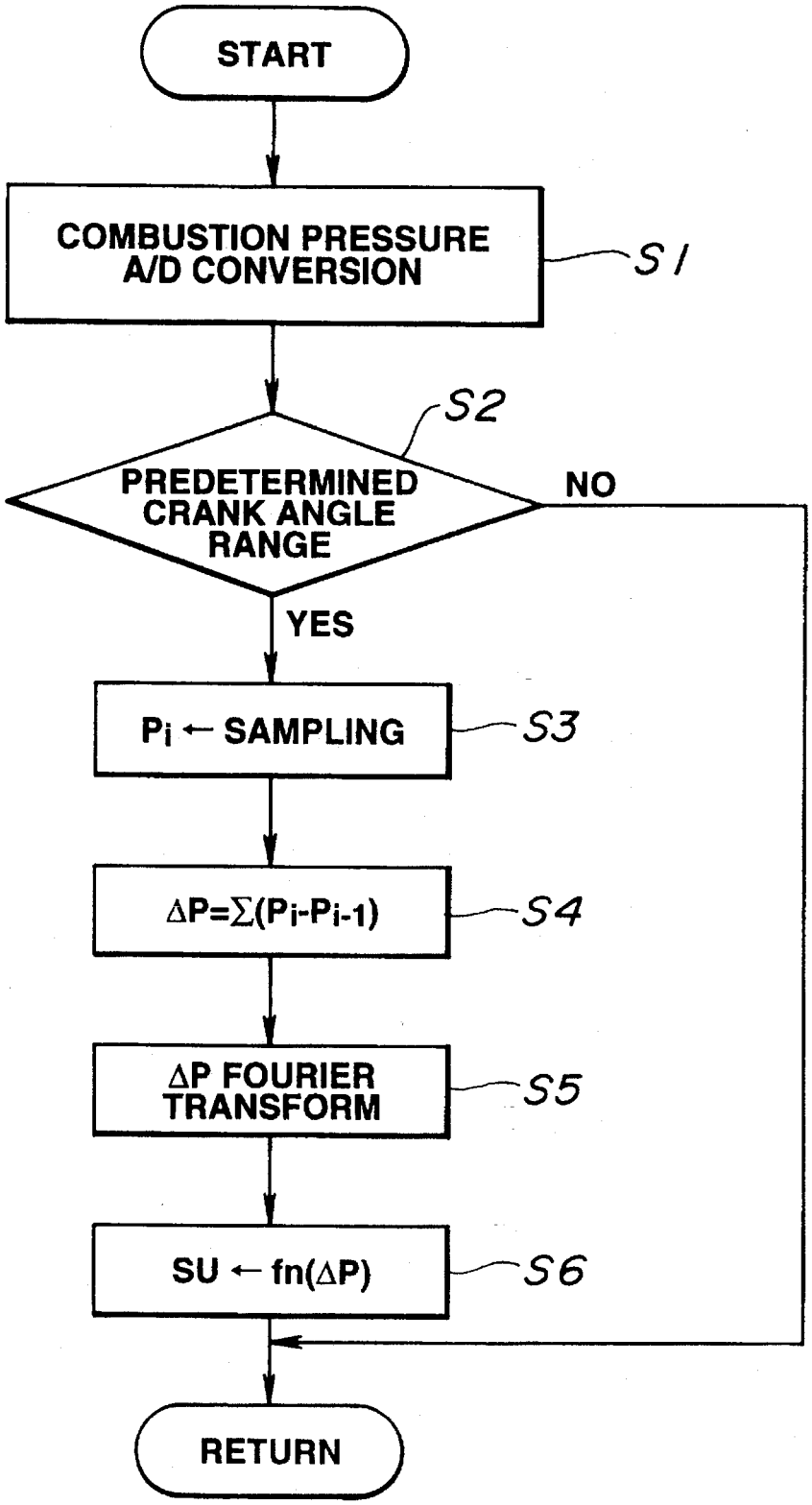
FIG. 3 shows a flowchart of steps carried out by the invention for calculating a surge torque level for enrichening a air/fuel ratio.

First, in a step 21 of FIG. 5, a target combustion pressure Pi0 (=K·Tp) and the actual combustion pressure Pi detected in step S1 of the routine of FIG. 3 are calculated to determine a combustion pressure ratio Td (=Pi0/Pi).

Then, in a step 22, the combustion pressure ratio Td is compared with a reference level SLTD. If the combustion pressure ratio is less than the reference level SLTD, the present state is maintained and the routine goes to RETURN. However, if the combustion pressure ratio Td is equal to or greater than the reference level SLTD, indicating that the combustion pressure Pi is insufficient and degrading of the combustion characteristics may result, the routine continues to a step 23.

At step 23, a data map corresponding to the initial air/fuel ratio correction value Sxo is selected and the air/fuel ratio correction volume is increased in a step by step fashion as the data map is sequentially switched to those having a larger value. For example, if a series of three maps a, b, c, are provided, as shown in FIG. 5, the inital map a will have tile smallest air/fuel ratio correction volume, then, before the operating conditions may become unsuitable, the routine will switch to the subsequent map b, and then map c to maintain optimal running of the engine.

At this, when the surge torque upon engine starting stays within permissible levels (step S14) the air/fuel ratio correction volume may drop drastically to form lean control of the air/fuel ratio, while the torque is monitored to effect stepwise rich control to insure that a sufficient air/fuel ratio is present for preventing insufficient torque generation. Thus, according to the system of the invention, optimal exhaust characteristics and fuel consumption characteristics may be established as soon as possible upon engine starting.

Further, although according to the invention, a surge torque level is calculated based on variation in the combustion pressure, calculation based on engine speed or the like may also be carried out for allowing the control to be response to engine operation conditions.

Thus, according to the invention, a required output is always provided at the time between engine starting and engine warming, while the engine may still run a lean as possible and establish the most efficient running characteristics as soon as possible after starting.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. An air/fuel ratio control system for an internal combustion engine, comprising:

combustion pressure detecting means active to detect a combustion pressure in an engine cylinder and output a signal indicative thereof;

operating characteristics discriminating means receivable of the output of said combustion pressure detecting means and active to compare said detected combustion pressure with a target combustion pressure and outputting a signal indicative of said comparison;

memory means storing a plurality of data maps relating to values of an air/fuel ratio correction volume higher and lower than a map indicative of a air/fuel ratio correction volume at a time of engine starting map selecting means active to select appropriate map data from said memory means appropriate for performing rich side control of said air/fuel ratio correction volume by selecting map data adjusting a value of said air/fuel ratio correction volume from a smaller value to a larger value based on the output of said operating characteristics discriminating means;

surge torque calculating means operable to calculate a surge torque level based on variation in said combustion pressure detected by said combustion pressure detecting means; and lean side air/fuel ratio control means operable such that, when surge torque level calculated by said surge torque calculating means is below a predetermined level the value of an air/fuel ratio correction volume from the a map currently selected by said map selecting means is reduced by a predetermined amount for performing lean control of the air/fuel ratio correction volume.

2. An air/fuel ratio control system as set forth in claim 1, wherein an initial air/fuel ratio correction volume is set according to selection of a map from said memory means by said map selection means, said selection being based on a fluid temperature detected by a fluid temperature sensor.

3. A air/fuel ratio control system as set forth in claim 2, wherein the air/fuel ratio correction volume differs in the plurality of data maps in that, when the detected fluid temperature is low, air/fuel ratio correction volume increase is substantially large.

4. A air/fuel ratio control system as set forth in claim 3, wherein the difference in air/fuel ratio correction volume between each of the data maps is established to be large.

5. A air/fuel ratio control system as set forth in claim 4, wherein when the engine becomes warm the value of the air/fuel ratio correction volume increase is kept small.

6. A air/fuel ratio control system as set forth in claim 5, wherein the air/fuel ratio correction volume increase between each of the plurality of maps is established to be small.

7. A method of controling an air/fuel ratio for an internal combustion engine, comprising the steps of:

(a) detecting a cylinder pressure in an engine cylinder;

(b) detecting a crank angle of said engine;

(c) sampling said detected cylinder pressure if the detected crank angle is within a predetermined crank angle range;

(d) determining a cylinder pressure differential based on at least two samplings of said cylinder pressure performed at different times;

(e) carrying out fourier transform operation on said differential value and determining levels for each frequency (f) extracting a frequency component indicative of surge torque and outputting a surge torque level signal indicative thereof;

(g) deriving a basic fuel jet volume based on an intake air volume and a rotational speed of said engine;

(h) selecting a correction value for said basic fuel jet volume according to a detected cooling fluid temperature;

(i) selecting an initial air fuel ratio correction volume from map data corresponding to said detected cooling fluid temperature;

(j) comparing said surge torque level signal with a reference value and reducing said air/fuel ratio by a predetermined amount if said surge torque level signal is lower than said reference value and raising said air/fuel ratio by a predetermined amount if said surge torque level is higher than or equal to said surge torque volume;

(k) adjusting said fuel jet volume according to said air/fuel ratio correction volume derived in step (j).

8. A air/fuel ratio control method as set forth in claim 7, wherein wherein said switching of said map data is performed according to the following steps:

comparing said detected combustion pressure with a target combustion pressure for deriving a combustion pressure ratio;

comparing said combustion pressure ratio with a reference value;

maintaining an initial map data if said combustion pressure ratio is lower than said reference value and selecting new map data if said combustion pressure is greater than or equal to said reference value.

9. A air/fuel ratio control method as set forth in claim 8, wherein an air/fuel ratio correction volume differs in the plurality of data maps in that, when the detected fluid temperature is low, air/fuel ratio correction volume increase is substantially large and a difference in air/fuel ratio correction volume between each of the data maps is established to be large.

10. A air/fuel ratio control method as set forth in claim 9, wherein when the engine becomes warm the value of the air/fuel ratio correction volume increase is kept small and the air/fuel ratio correction volume increase between each of the plurality of maps is established to be small.

11. A air/fuel ratio control method as set forth in claim 7, wherein said frequency component extracted for forming said surge torque level signal is in a range from 3–7 Hz.

* * * * *